US011359519B2

(12) United States Patent
Radzi et al.

(10) Patent No.: US 11,359,519 B2
(45) Date of Patent: Jun. 14, 2022

(54) OFFSHORE ELECTRICAL POWER PLANT

(71) Applicant: SINGLE BUOY MOORINGS INC., Marly (CH)

(72) Inventors: Nor Fadilah Ahmad Radzi, Monaco (MC); Wouter Sassen, Monaco (MC)

(73) Assignee: SINGLE BUOY MOORINGS INC., Marly (CH)

( * ) Notice: Subject to any disclaimer, the term of this patent is extended or adjusted under 35 U.S.C. 154(b) by 140 days.

(21) Appl. No.: 16/965,505

(22) PCT Filed: Jan. 29, 2019

(86) PCT No.: PCT/EP2019/052114

§ 371 (c)(1),
(2) Date: Jul. 28, 2020

(87) PCT Pub. No.: WO2019/145560

PCT Pub. Date: Aug. 1, 2019

(65) Prior Publication Data

US 2021/0047944 A1 Feb. 18, 2021

(30) Foreign Application Priority Data

Jan. 29, 2018 (EP) ..... 18153955

(51) Int. Cl.

| | |
|---|---|
| ***F01K 23/10*** | (2006.01) |
| ***B63B 83/20*** | (2020.01) |
| ***B63B 83/30*** | (2020.01) |
| ***B63B 35/44*** | (2006.01) |
| ***F01K 15/00*** | (2006.01) |

(52) U.S. Cl.

CPC ..... *F01K 23/10* (2013.01); *B63B 35/44* (2013.01); *B63B 83/20* (2020.01); *B63B 83/30* (2020.01);

(Continued)

(58) Field of Classification Search

CPC ..... B63B 83/20; B63B 85/44; F01K 23/10; F01K 15/00

See application file for complete search history.

(56) References Cited

U.S. PATENT DOCUMENTS 6,442,924 B1 * 9/2002 Talley ..... F01K 23/106 60/39.182
6,546,739 B2 * 4/2003 Frimm ..... F17C 1/002 62/240

(Continued)

FOREIGN PATENT DOCUMENTS

EP 2 835 521 2/2015
EP 3 255 365 12/2017

(Continued)

OTHER PUBLICATIONS

International Search Report for PCT/EP2019/052114 dated May 9, 2019, 4 pages.

(Continued)

*Primary Examiner* — Todd E Manahan
*Assistant Examiner* — Thuyhang N Nguyen
(74) *Attorney, Agent, or Firm* — Nixon & Vanderhye

(57) ABSTRACT

A floating vessel equipped with a power plant includes a hull and a process deck arranged on a portion of the hull above compartments within the hull. The power plant includes a fuel source and at least one electrical power generator driven by a gas turbine; the fuel source arranged for providing fuel to the gas turbine. Per gas turbine, the floating vessel is equipped with a steam production unit coupled to the gas turbine exhaust for receiving heat to produce pressurized steam. Per each steam production unit, the floating vessel is equipped with at least one secondary power generator driven by a steam turbine, which is coupled to the steam production unit for receiving steam. Each gas turbine and steam production unit are positioned on the process deck, and each (Continued)

secondary power generator and steam turbine are positioned under the process deck in the one or more compartments.

20 Claims, 4 Drawing Sheets

(52) U.S. Cl.
CPC ..... *F01K 15/00* (2013.01); *B63B 2035/444* (2013.01)

(56) References Cited

U.S. PATENT DOCUMENTS

| | | | | |
|---|---|---|---|---|
| 7,357,092 | B2 * | 4/2008 | Park | B63B 35/44 290/1 A |
| 9,062,525 | B2 * | 6/2015 | Maclean | F01K 13/00 |
| 9,950,774 | B2 * | 4/2018 | Brinkel | B63B 35/44 |
| 2006/0260315 | A1 | 11/2006 | Park | |
| 2014/0345299 | A1 * | 11/2014 | Kirk | E21B 43/12 62/53.2 |

FOREIGN PATENT DOCUMENTS

| | | |
|---|---|---|
| GB | 870589 | 6/1961 |
| WO | 2015/115813 | 8/2015 |

OTHER PUBLICATIONS

Written Opinion of the ISA for PCT/EP2019/052114 dated May 9, 2019, 6 pages.

* cited by examiner

OFFSHORE ELECTRICAL POWER PLANT

This application is the U.S. national phase of International Application No. PCT/EP2019/052114 filed Jan. 29, 2019 which designated the U.S. and claims priority to EP Patent Application No. 18153955.2 filed Jan. 29, 2018, the entire contents of each of which are hereby incorporated by reference.

FIELD OF THE INVENTION

The present invention relates to a floating vessel equipped with a power plant. Also, the invention relates to a method for manufacturing such a floating vessel. Moreover, the invention relates to the use of such a floating vessel.

BACKGROUND

Distributing electric power to remote locations is often difficult due to losses over a relatively long distance along the electric power grid. As a result, in such remote locations, the electric power grid may have poor quality and low power output.

For a few decades, floating power generation systems are known that have been provided to remote locations supplying limited produced power, from a few Mega-Watt (MW) up to about 50 MW. Such floating power generation systems consist of at least a vessel that has onboard power generators and transformers. Fuel may be stored on board or on a separate unit. Usually, a floating power generation system is moored near shore and is electrically coupled to the land based power grid. The location of the floating power generation system is typically at such a distance that electric power can be transferred economically, without large losses.

Since these systems are floating, they can be deployed relatively easily and quickly in comparison to land based power plants.

Due to increasing energy consumption, there is a demand for floating power generation systems that provide higher power outputs. At the same time there is a need for power generation that can meet low emissions ($CO_2$ and $NO_x$) norms such as gas or LNG. However, upscaling such systems has some constraints in terms of size and costs. On board storage of LNG requires a containment system that can store LNG at −163° C. which can be provided in a new vessel or in an existing vessel. In the latter case plot space has to be made available to house the regasification and power generation equipment. Since the original vessel size is limited, the LNG storage capacity is to be carefully balanced with the amount of power generation equipment that is installed. Compared to a small power plant, a larger power plant requires more fuel and therefore a larger LNG storage but also more plot space.

It is an object of the invention to overcome or mitigate the disadvantage from the prior art.

SUMMARY OF THE INVENTION

The object is achieved by a floating vessel as defined by claim 1.

According to the invention, in such a vessel, the arrangement of the power generator section comprises at least one electrical power generator driven by a gas turbine in combination with an additional electrical power generator driven by a steam turbine. The one or more gas turbines are driven by natural gas from regasification of LNG stored in the LNG storage onboard the floating vessel. The steam turbine is driven by pressurized steam that is produced by a steam production unit using exhaust heat from the one or more gas turbines. This arrangement of power generators allows to increase the efficiency of the floating power generation system per amount of LNG. In addition, arranging the gas turbine, its associated power generator and the steam production unit on or above process deck and the steam turbine and the additional electrical power generator stacked vertically below them in a compartment within the hull, allows for a compact construction that reduces the required desk space significantly. As a result, a larger number of gas turbines can be placed on the vessel deck, and a larger number of steam turbines and associated power generators can be placed within the vessel, which allows to increase the power output without compromising the LNG storage and without the need to construct a larger vessel.

Embodiments with various numbers of gas turbines, steam production units and steam turbines are possible depending on the power ratings of the equipment. For example, one gas turbine is coupled with one steam production unit and one steam turbine, or a pair of gas turbines is coupled with one or two steam production units that deliver steam to a single steam turbine.

In an embodiment, the steam production unit is stacked vertically above the at least one gas turbine and power generator(s), and the steam turbine and power generator is stacked vertically below the gas turbine. This arrangement allows an even compacter construction.

In an embodiment, a conduit for transporting steam is provided between each steam production unit on/above the process deck and the steam turbine associated with the steam production unit that is positioned under the process deck in the one or more compartments.

In an embodiment, the fuel source is a fuel gas source comprising at least one LNG storage tank for storing LNG and a regasification unit coupled to the at least one LNG storage tank for producing a stream of regasified natural gas from stored LNG.

In an embodiment, the floating vessel is a converted LNG carrier having a number of LNG storage tanks originally installed for storage of the fuel gas, in which a portion of the number of originally installed LNG storage tanks is removed at positions within the location of the process deck.

According to a further embodiment, the one or more compartments within the hull are arranged at the location of removed LNG storage tanks.

In an embodiment, each power transformer unit is coupled to a pair of power generators or a pair of secondary power generators or a pair of a power generator and a secondary power generator, with each power generator coupled to a gas turbine and each secondary power generator coupled to a steam turbine.

The present invention relates to a method for manufacturing a floating vessel equipped with an electric power plant, comprising: providing a LNG carrier vessel as the floating vessel, the LNG carrier vessel having a number of LNG storage tanks mounted in the hull; removing a portion of the number of LNG storage tanks; arranging a process deck or reinforcing an existing process deck on the hull at the location of the removed LNG storage tanks, and creating one or more compartments within the hull under the process deck; arranging on the vessel at least one electrical power generator driven by a gas turbine, with the remaining LNG storage tanks coupled through a LNG regasification system to the gas turbine of the at least one power generator for delivery of fuel gas to the gas turbine; per each gas turbine, providing a steam production unit that is coupled to an exhaust of the gas turbine for receiving heat to produce steam, per each steam production unit, providing an secondary power generator driven by a steam turbine, which steam turbine is coupled to the steam production unit for receiving steam, wherein the method further comprises positioning the gas turbine and steam production unit on or above the process deck, and positioning the secondary power generator and steam turbine under the process deck in the one or more compartments, stacked below the gas turbine and steam production unit.

According to an embodiment, the method further comprises providing a power transformer unit on the process deck for coupling to one or more of the at least one power generator and the at least one secondary power generator; providing electric terminals for connecting a power output of the power transformer unit to an external power grid.

Advantageous embodiments are further defined by the dependent claims.

BRIEF DESCRIPTION OF DRAWINGS

The invention will be explained in more detail below with reference to drawings in which illustrative embodiments thereof are shown. They are intended exclusively for illustrative purposes and not to restrict the inventive concept, which is defined by the claims.

In each of the Figures, similar or corresponding elements will be indicated by the same reference.

DESCRIPTION OF EMBODIMENTS

Figure 1:
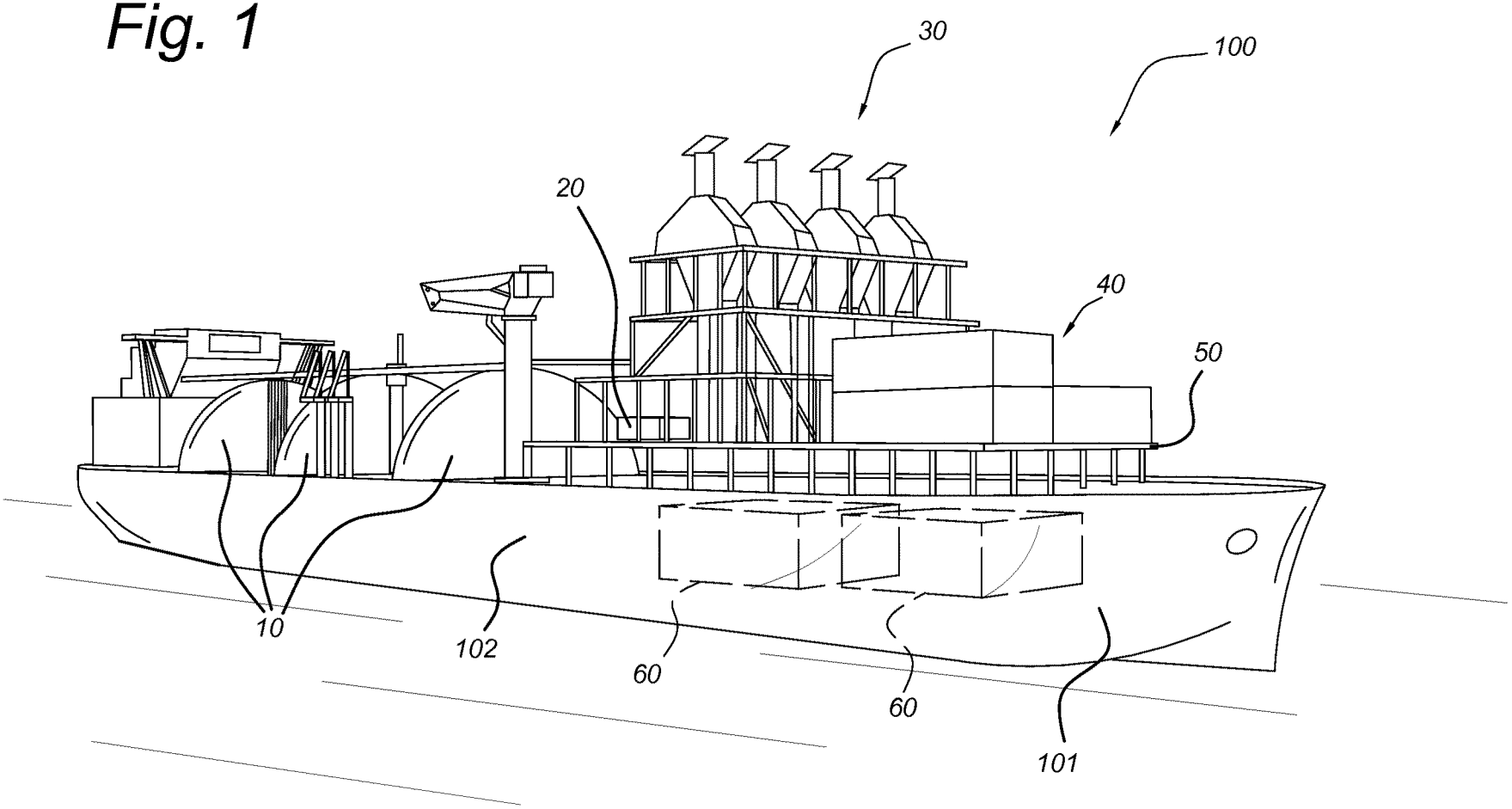
FIG. 1 shows a perspective view of a floating vessel in accordance with an embodiment of the invention.

FIG. 1 shows a perspective view of a floating vessel 100 in accordance with an embodiment of the invention.

According to the invention the floating vessel 100 is arranged as a floating power generation system that can be deployed at a near shore location for production of electric power. The floating power generation system is configured for coupling to a land based power grid (not shown) to distribute electric power to consumer devices on the grid.

The floating vessel 100 comprises one or more LNG storage tanks 10, a regasification unit 20, a power plant 30 and a transformer station 40.

The LNG storage tank(s) 10 is (are) coupled to the regasification unit 20 to feed LNG from the tank to the regasification unit. The regasification unit 20 is coupled to the power plant 30 for supplying natural gas. The power plant 30 comprises power generators that are driven by natural gas and is electrically coupled to the transformer station 40 which is configured to step up the output voltage of the generated electrical power to a required voltage on the land based power grid.

The power plant and the transformer station are arranged on a process deck 50 that is adjacent to an area 11 holding the LNG storage tank(s).

As explained in more detail with reference to FIGS. 2 and 3, the power plant 30 extends in one or more compartments 60 within the hull 102 below the process deck 50. The compartments 60 are schematically indicated by dashed lines.

In this embodiment, the floating vessel 100 can be jetty moored or positioned in a spread moored arrangement by a set of mooring lines.

Figure 2:
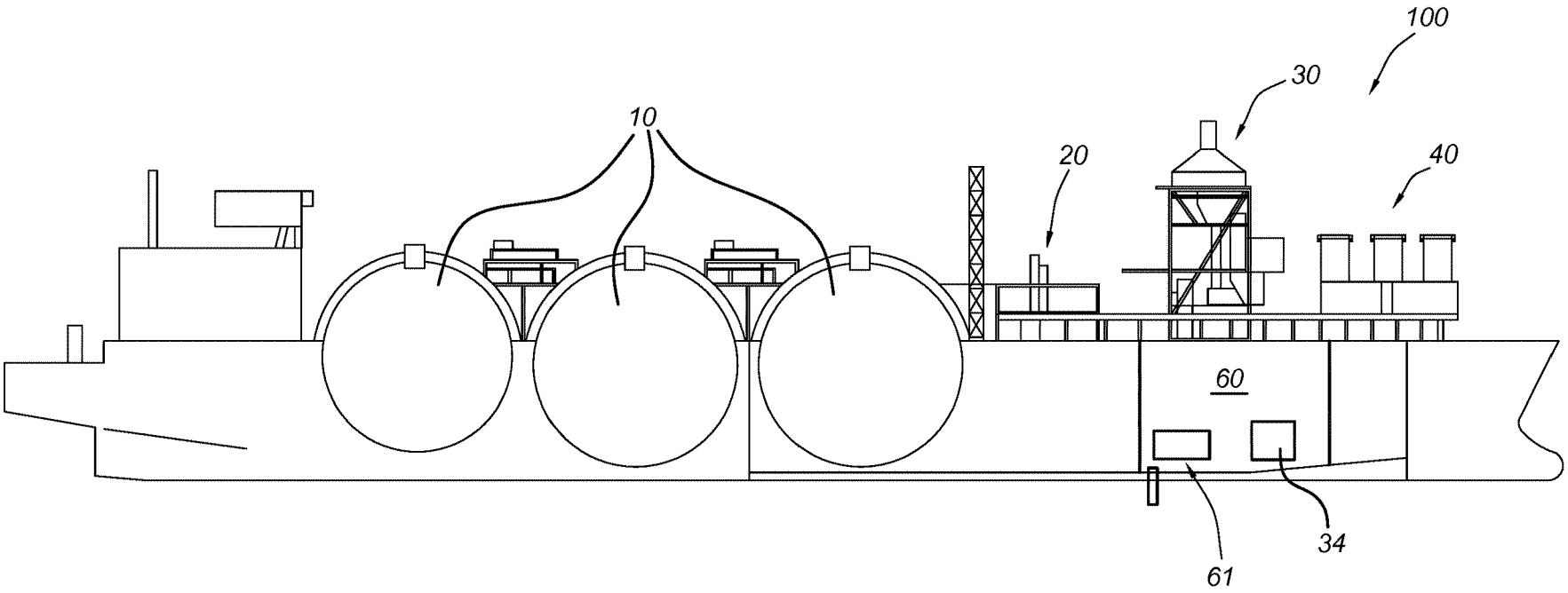
FIG. 2 shows a schematic cross-section of a floating vessel in accordance with an embodiment of the invention.

FIG. 2 shows a schematic cross-section of a floating vessel 100 in accordance with an embodiment of the invention.

In an embodiment, the power plant 30 comprises one or more gas turbines 32, one or more steam turbines 34 and at least one steam production unit 36.

According to the invention, the one or more gas turbines and steam production unit(s) are positioned on or above the process deck 50 while the steam turbine(s) is positioned below the process deck in a compartment 60 within the hull of the floating vessel.

The gas turbine(s) 32 is arranged to be driven by combustion of a stream of natural gas which is received from the regasification unit 20.

Preferably, boil off gas from the LNG storage tanks is collected, compressed and added to the stream of natural gas created by the regasification unit before the natural gas stream enters the gas turbine(s).

The exhaust of each gas turbine is coupled (not shown) to the steam production unit which is arranged to produce pressurized steam from the exhaust heat of the gas turbine.

An output of the steam production unit is coupled to a steam input of the steam turbine. By using the exhaust heat from the gas turbine for generating steam as feed to the steam turbine, the efficiency of the combustion process is significantly improved.

The coupling of one or more gas turbines with a steam production unit and with one or more steam turbines creates a modular unit denoted here as power generation unit or power train or power block.

According to the invention, within each power generation unit, the gas turbine(s) and steam production unit are vertically stacked substantially above the steam turbine, and the steam turbine is inside the compartment in the hull below the process deck. By the vertical stacking the required deck space is reduced in comparison the space required in a horizontal concatenated set-up.

In a further embodiment, the steam production unit is stacked above the gas turbine, which results in a comparatively even smaller footprint of the power generation unit on the process deck.

Each of the gas turbine(s) and steam turbine is mechanically coupled to an associated power generator for generating AC electric power. Each power generator is electrically connected to a transformer unit for producing electric power with an output voltage in accordance with the voltage of the power grid.

Figure 3:
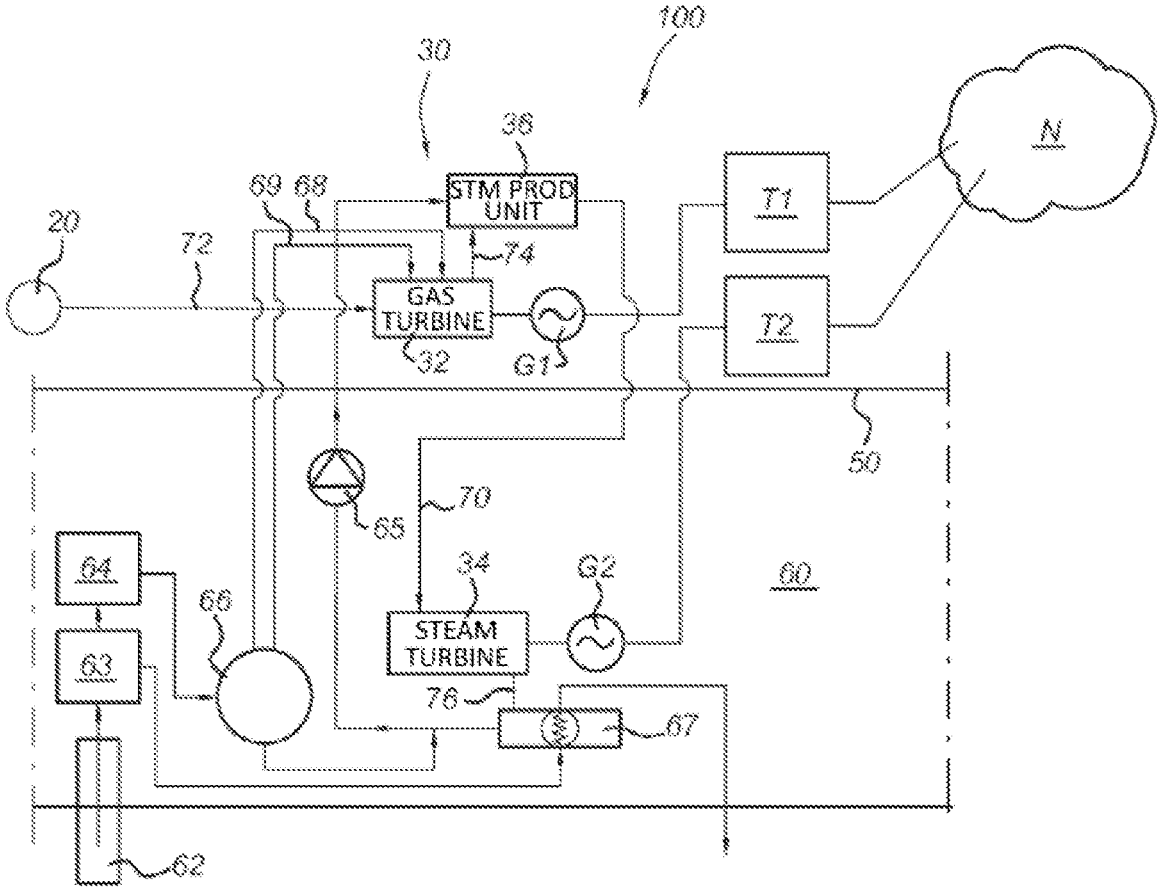
FIG. 3 shows schematically a power plant comprising a gas turbine and a steam turbine, in accordance with an embodiment of the invention.

FIG. 3 shows schematically a power generation unit in accordance with an embodiment of the invention.

As explained above, a power generation unit comprises a steam turbine that is positioned in a compartment 60 of the hull below the process deck 50, and positioned above the steam turbine, one or more gas turbines and a steam production unit on/above the process deck.

Within the compartment 60 the power generation unit comprises auxiliary equipment 61 that is arranged to support the steam cycle, i.e., a water supply unit 62, 63, 64, 65, 66 to supply make-up water to the steam production unit 36, and a steam condenser 67 for the steam turbine to recover water from steam processed by the steam turbine 34. The water supply unit is also arranged to supply cooling water to the steam condenser 67 for condensation of steam.

In an embodiment, the water supply unit comprises a seawater lift pump 62 for taking in water, a coarse filter 63, a purification unit 64, and a buffer volume 66. In the compartment, an entry of the seawater lift pump is arranged at a level as low as possible to obtain a sufficient pressure head. The seawater lift pump 62 is connected to the coarse filter 63 which is then connected to the steam condenser 67 for providing cooling water to the steam condenser for cooling down of the depressurized steam from the steam turbine 34. The cooling water may be discharged after passing the steam condenser.

The seawater lift pump 62 is further arranged to deliver a stream of the coarsely filtered water to the purification unit 64 through one or more coarse filters 63. The purification unit 64 is configured to desalinate the water in such a way that the purified water can be used as make-up water for steam generation. An output of the purification unit 64 is connected to a buffer volume 66 for storing purified water. Next, the buffer volume 66 is connected by a conduit to a water inlet of the steam cycle for example at the exit of the steam condenser where the condensate is collected. To transport the purified water from this entry level to the level of the steam production unit a water pump 65 is used. In the steam production unit 36, the purified water is transformed to pressurized steam.

Depending on the type of gas turbine, purified water can be supplied through supply line 68 to the gas turbine(s) 32 for deNOx purposes of the exhaust gases.

For the purpose of power augmentation of the gas turbine, purified water may be injected through feed line 69 in the combustion chamber of the gas turbine, depending on the gas turbine type.

During use, steam from the steam production unit is transported through a steam pipe 70 to the steam turbine 34. After passing the steam turbine 34, steam enters the steam condenser 67 through conduit 76 and is transformed to water. The condensed water is recovered and recycled to the steam production unit or transported to the buffer volume 66.

Typically, in this arrangement, the level of the entry of the seawater lift pump 62 is below the level of the steam turbine 34 and the level of the condenser 67 to further compact the design. The gas turbine 32 is on a level on or above the process deck 50 positioned above the steam turbine 34. The steam production unit 36 is on a level above the gas turbine 32.

Additionally, in FIG. 3, the connections between the gas turbine, the steam production unit and the steam turbine are shown in some detail.

A supply line 72 for natural gas from the regasification unit 20 to the gas turbine 32 is shown.

Exhaust gas from the gas turbine is supplied 74 to the steam production unit 36 to generate pressurized steam from the purified water. In an embodiment, the gas turbine is provided with a radial exhaust, which in this arrangement allows a horizontal orientation of the gas turbine (rotor) 32 with the steam production unit 36 positioned above the gas turbine.

The gas turbine 32 is mechanically coupled to the electrical power generator G1. The electrical power generator G1 is electrically coupled to a transformer unit T1 that is further connected to the power grid N by means of overhead power lines or a subsea power cable.

The steam turbine 34 is mechanically coupled to a secondary electrical power generator G2. The secondary electrical power generator G2 is electrically coupled to a second transformer unit T2 that is further connected to the power grid N.

In practice, power generators may be rated at an output voltage between 11 and 15 kV (or more particular 13.8 kV) AC. The transformer units may be configured to step up the voltage to e.g., 150 kV matching the voltage of the power grid N.

The floating vessel 100 according to the invention can be a new built vessel which in an embodiment, can have the dimensions of an LNG carrier vessel but can also be a barge type floater. Such an LNG carrier vessel or floater may have from stern to bow one or more LNG storage tanks 10 of either membrane type, Moss type or C type, and one or more compartments 60 in the hull 102 for holding one or more steam turbines 34 and additional equipment 61 as described above. Each of the compartments in the hull has a similar length and width as the compartments holding the LNG storage tanks.

Alternative to a new built vessel, the floating vessel 100 can be a converted LNG carrier vessel in which one or more of the existing (e.g., four or five) LNG storage tanks 10 have been removed and the compartments 60 in the hull 102 have been modified to hold one or more steam turbines 34 and additional equipment 61, one in each compartment. Depending on the type of the removed LNG storage tanks, a new process deck 50 is constructed above the compartments in the hull, or the existing process deck 50 is reinforced, before the gas turbine(s), steam production unit(s), power generator(s), transformer units are installed on the process deck.

Within the compartments, a floor may be present on which the steam turbine and the additional equipment are arranged.

Accordingly, the present invention relates to a method for manufacturing a floating vessel equipped with an electric power plant, comprising:

providing a LNG carrier vessel as the floating vessel, the LNG carrier vessel having a number of LNG storage tanks mounted in the hull; removing a portion of the number of LNG storage tanks; arranging a new process deck or reinforcing an existing process deck on the hull at the location of the removed LNG storage tanks, and creating one or more compartments with one or more floors within the hull under the process deck; arranging on the vessel at least one electrical power generator driven by a gas turbine, with the remaining LNG storage tanks coupled through a LNG regasification system to the gas turbine of the at least one power generator for delivery of fuel gas to the gas turbine; per each gas turbine, providing a steam production unit that is coupled to an exhaust of the gas turbine for receiving heat and producing steam; per each steam production unit, providing an secondary power generator driven by a steam turbine, which is coupled to the steam production unit for receiving steam, wherein the method further comprises: positioning the gas turbine and steam production unit on or above the process deck, and positioning the secondary power generator and steam turbine under the process deck in the one or more compartments.

The power generation unit (the modular unit) may be embodied by various combinations of gas turbines 32 and steam turbines 34 depending on the required output power of the power generation unit or the complete power plant.

As known to the skilled in the art, gas turbines and steam turbines are available in various power ratings. A gas turbine may have an output power of about 50 MW depending on its type. Likewise steam turbines may have an output power of about 20 MW.

According to the invention, the power generation unit may comprise for example one gas turbine, one steam production unit and one steam turbine. This combination may have an output power of about 70 MW at maximum operating conditions, taking into account internal power usage on the floating vessel.

In an alternative embodiment, the power generation unit comprises two gas turbines, one or two steam production units and one steam turbine. In this embodiment, pressurized steam produced in the one or two steam production units by means of the exhaust heat of the two gas turbines is supplied to the single steam turbine. The output power rating of this power generation unit to the power grid N is about 125 MW.

On a vessel of the LNG carrier type, the process deck 50 may provide sufficient space for one, two, three or four of such power generation units, creating an output power rating of 125, 250, 375, or 500 MW.

Alternatively, gas turbines and associated steam turbines with a larger power generating capability may be selected to obtain a similar overall power generation.

The LNG storage tanks 10 are typically loaded from an LNG shuttle tanker. For an LNG carrier type vessel, each LNG storage tank can have a capacity between about 25,000 and about 40,000 $m^3$. Depending on the operating conditions, remaining storage capacity and the installed power rating, a so-called autonomy time between subsequent LNG loading operations can be determined for the floating vessel.

The LNG is typically loaded using a side-by-side ship-to-ship transfer system.

In an alternative embodiment, a liquid fuel such as diesel is used as fuel source instead of LNG. In this embodiment, instead of applying gas turbine(s) and LNG storage tanks, liquid fuel storage tanks and one or more engines running on the liquid fuel can be applied to drive the power generator. The exhaust gases from the engine(s) are then used as heat source for the steam production unit(s) to produce steam for the steam turbine(s).

Figure 4:
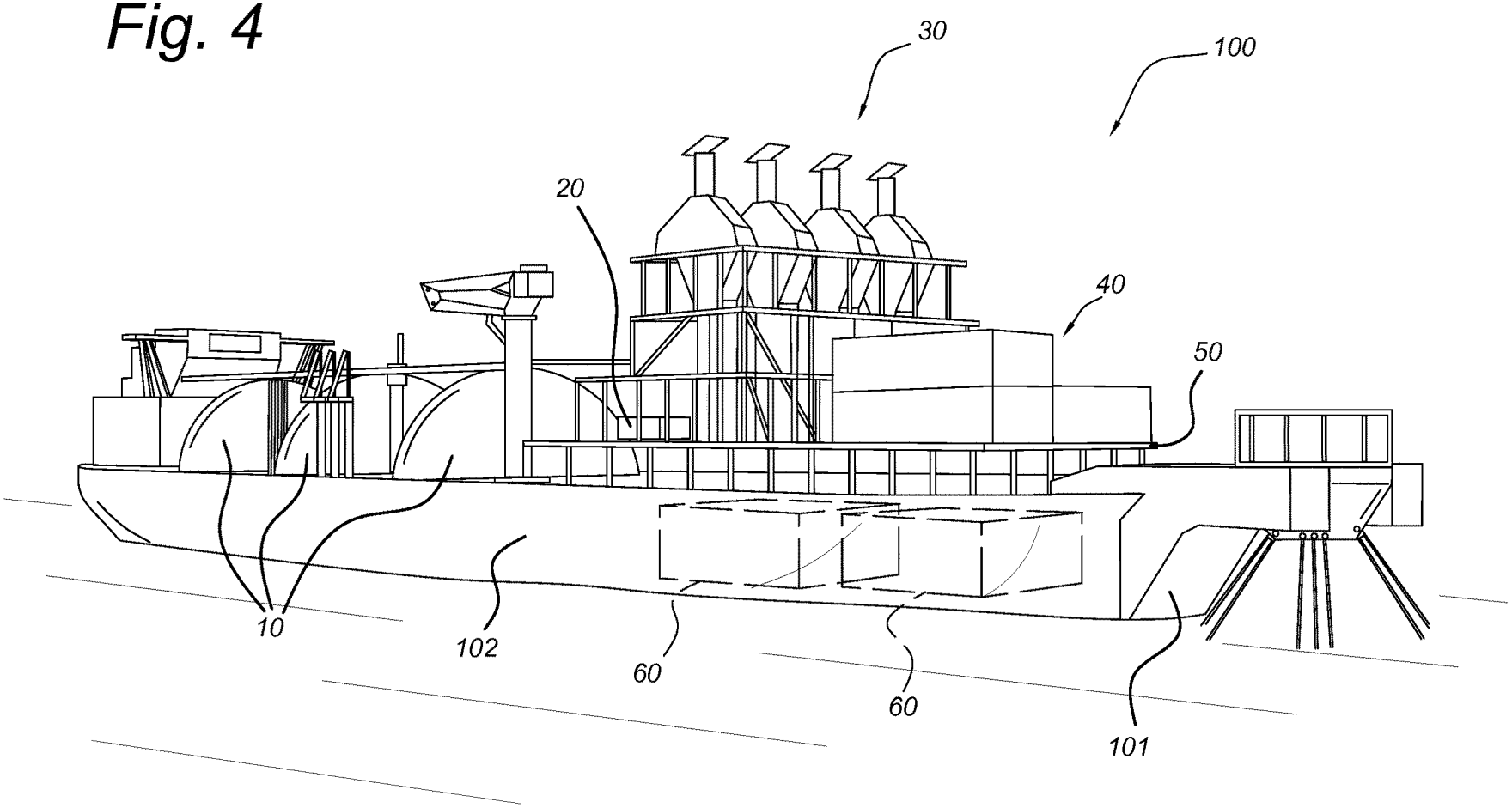
FIG. 4 shows a perspective view of a floating vessel in accordance with an embodiment of the invention.

FIG. 4 shows a floating vessel in accordance with an embodiment of the invention.

Shown here, the bow 101 of the floating vessel 100 is configured for external turret mooring. By using turret mooring, the vessel can weathervane depending on water flow and/or wind direction. Optionally, by using turret mooring, the electrical connection (not shown) between the floating vessel and the power grid can be implemented as a submerged cable running between a turret buoy and the shore.

The invention has been described with reference to some embodiments. Obvious modifications and alterations will occur to others upon reading and understanding the preceding detailed description. It is intended that the invention be construed as including all such modifications and alterations insofar as they come within the scope of the appended claims.

In this document and in its claims, the verb "to comprise" and its conjugations are used in their non-limiting sense to mean that items following the word are included, without excluding items not specifically mentioned. In addition, reference to an element by the indefinite article "a" or "an" does not exclude the possibility that more than one of the element is present, unless the context clearly requires that there be one and only one of the element. The indefinite article "a" or "an" thus usually means "at least one".

The invention claimed is:

1. A floating vessel equipped with a power plant and comprising a hull and a process deck arranged on a portion of the hull above one or more compartments within the hull, the power plant comprising a fuel source, and at least one electrical power generator driven by a gas turbine; the fuel source arranged for providing fuel to the gas turbine of the at least one power generator, wherein the fuel source is a fuel gas source comprising at least one LNG storage tank for storing LNG and a regasification unit coupled to the at least one LNG storage tank for producing a stream of regasified natural gas from stored LNG, and per one or more gas turbines, the floating vessel is equipped with at least one steam production unit coupled to an exhaust of the one or more gas turbines for receiving heat to produce pressurized steam;

per each steam production unit, the floating vessel is equipped with at least one secondary power generator driven by a steam turbine, which is coupled to the respective steam production unit for receiving produced steam;

each gas turbine of the one or more gas turbines and the at least one steam production unit are positioned on or above the process deck, and each of the respective secondary power generator and the steam turbine are positioned under the process deck in the one or more compartments, and wherein the floating vessel is a converted LNG carrier having a number of the LNG storage tanks originally installed for storage of the fuel gas, in which a portion of the number of originally installed LNG storage tanks is removed at positions within the location of the process deck.

2. The floating vessel according to claim 1, further comprising a plurality of steam production units, wherein a conduit for transporting steam is provided between each steam production unit on or above the process deck and the steam turbine associated with the respective steam production unit is positioned under the process deck in the one or more compartments.

3. The floating vessel according to claim 2, wherein the at least one steam production unit is stacked above the one or more gas turbines.

4. The floating vessel according to claim 2, wherein the floating vessel on the process deck further comprises a power transformer unit for transforming an input voltage to an output voltage, provided with a power input coupled to one or more of at least one power generator and at least one secondary power generator for receiving the input voltage and provided with a power output for outputting the output voltage.

5. The floating vessel according to claim 2, wherein the vessel comprises a turret mooring system.

6. The floating vessel according to claim 1, wherein the at least one LNG storage tank is a Moss-type LNG tank or a membrane LNG tank or a type-C LNG tank.

7. The floating vessel according to claim 6, wherein the at least one steam production unit is stacked above the one or more gas turbines.

8. The floating vessel according to claim 6, wherein the floating vessel on the process deck further comprises a power transformer unit for transforming an input voltage to an output voltage, provided with a power input coupled to one or more of at least one power generator and at least one secondary power generator for receiving the input voltage and provided with a power output for outputting the output voltage.

9. The floating vessel according to claim 6, wherein the vessel comprises a turret mooring system.

10. The floating vessel according to claim 1, wherein the at least one steam production unit is stacked above the one or more gas turbines.

11. The floating vessel according to claim 10, wherein the floating vessel on the process deck further comprises a power transformer unit for transforming an input voltage to an output voltage, provided with a power input coupled to one or more of at least one power generator and at least one secondary power generator for receiving the input voltage and provided with a power output for outputting the output voltage.

12. The floating vessel according to claim 10, wherein the vessel comprises a turret mooring system.

13. The floating vessel according to claim 1, wherein the floating vessel on the process deck further comprises a power transformer unit for transforming an input voltage to an output voltage, provided with a power input coupled to one or more of at least one power generator and at least one secondary power generator for receiving the input voltage and provided with a power output for outputting the output voltage.

14. The floating vessel according to claim 1, wherein the one or more compartments within the hull are arranged at the location of removed LNG storage tanks.

15. The floating vessel according to claim 1, claims, wherein the vessel comprises a turret mooring system.

16. The floating vessel according to claim 1, wherein each power transformer unit is coupled to a pair of power generators or a pair of secondary power generators or a pair of a power generator and a secondary power generator, with each power generator coupled to a gas turbine and each secondary power generator coupled to a steam turbine.

17. The floating vessel according to claim 1, comprising a water supply unit within the compartment in the hull, the water supply unit comprising a seawater lift pump, filter and purification unit(s), in which the seawater lift pump is arranged at a bottom location of the compartment for in-take of water.

18. The floating vessel according to claim 1, wherein the fuel source comprises an additional LNG storage vessel provided with LNG storage tanks for storing LNG.

19. Method for manufacturing a floating vessel equipped with an electric power plant, comprising:

providing a LNG carrier vessel as the floating vessel, the LNG carrier vessel having a number of LNG storage tanks mounted in the hull;

removing a portion of the number of LNG storage tanks;

arranging a process deck or reinforcing an existing process deck on the hull at the location of the removed LNG storage tanks, and creating one or more compartments within the hull under the process deck;

arranging on the vessel at least one electrical power generator driven by a gas turbine, with the remaining LNG storage tanks coupled through a LNG regasification system to the gas turbine of the at least one power generator for delivery of fuel gas to the gas turbine;

per one or more gas turbines, providing at least one steam production unit that is coupled to an exhaust of the one or more gas turbines for receiving heat to produce steam, per each steam production unit, providing an secondary power generator driven by a steam turbine, in which the steam turbine is coupled to the respective steam production unit for receiving steam;

wherein the method further comprises:

positioning the one or more gas turbines and the at least one steam production unit on or above the process deck, and positioning the respective secondary power generator and the steam turbine under the process deck in the one or more compartments, stacked below the one or more gas turbines and the at least one steam production unit.

20. The method according to claim 19, further comprising:

providing a power transformer unit on the process deck for coupling to one or more of the at least one power generator and the at least one secondary power generator, providing electric terminals for connecting a power output of the power transformer unit to an external power grid.

* * * * *